US006698806B2

(12) United States Patent
Brammall et al.

(10) Patent No.: US 6,698,806 B2
(45) Date of Patent: Mar. 2, 2004

(54) PLUG DOOR HANDLE BOLT SEAL LOCKING DEVICE

(75) Inventors: Terrence N. Brammall, Angola, IN (US); Craig B. Hamilton, Waterloo, IN (US); Stanley Gilbert, Angola, IN (US)

(73) Assignee: Transguard Industries, Inc., Angola, IN (US)

( * ) Notice: Subject to any disclaimer, the term of this patent is extended or adjusted under 35 U.S.C. 154(b) by 92 days.

(21) Appl. No.: 09/878,526

(22) Filed: Jun. 11, 2001

(65) Prior Publication Data

US 2002/0185872 A1 Dec. 12, 2002

(51) Int. Cl.[7] ..... E05C 19/08

(52) U.S. Cl. ..... 292/286; 292/DIG. 32; 292/DIG. 2; 292/346

(58) Field of Search ..... 292/286, 284, 292/282, 289, 292, 346, 327, 208, 204, DIG. 32, DIG. 2, 205; 70/54, 55, 56, 417, 212, 209, 176–180, 202–203

(56) References Cited

U.S. PATENT DOCUMENTS 4,513,773 A * 4/1985 Hardiman, Jr. ..... 137/382
4,898,008 A * 2/1990 Eberly ..... 292/DIG. 32
5,118,149 A * 6/1992 Emmons ..... 292/205
5,165,263 A * 11/1992 Perron et al. ..... 70/177
5,692,401 A * 12/1997 Khalsa ..... 70/95
5,701,768 A * 12/1997 Khalsa ..... 70/14
5,743,118 A * 4/1998 Anderson ..... 70/56
5,791,702 A * 8/1998 Liroff ..... 292/307 R
6,010,166 A * 1/2000 Hamilton et al. ..... 292/282
6,036,240 A * 3/2000 Hamilton et al. ..... 292/150
6,357,266 B1 * 3/2002 Van Buren ..... 70/211

* cited by examiner

*Primary Examiner*—J. J. Swann
(74) *Attorney, Agent, or Firm*—Carella, Byrne, Bain, et al.; John G. Gilfillan; William Squire

(57) ABSTRACT

An elongated channel protector has an end wall that precludes axial displacement of the protector along an elongated rail car plug door operating handle in one direction. Angle shaped members extend from the protector laterally for engaging a cover appurtenance on the door for precluding axial displacement of the protector in the opposite direction. A pair of legs depend from the protector side walls and have aligned holes for receiving a bolt seal. Tubular elements surround the holes to protect the seal head and locking body. The seal is seated beneath the handle which is covered by the protector locking the protector to the handle.

16 Claims, 3 Drawing Sheets

FIG. 7
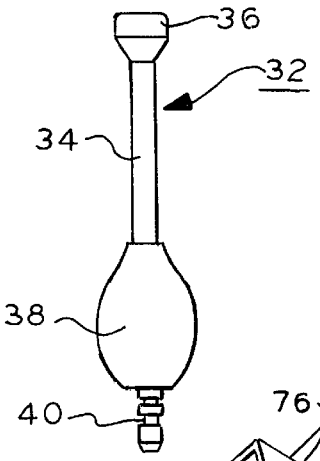
FIG. 3
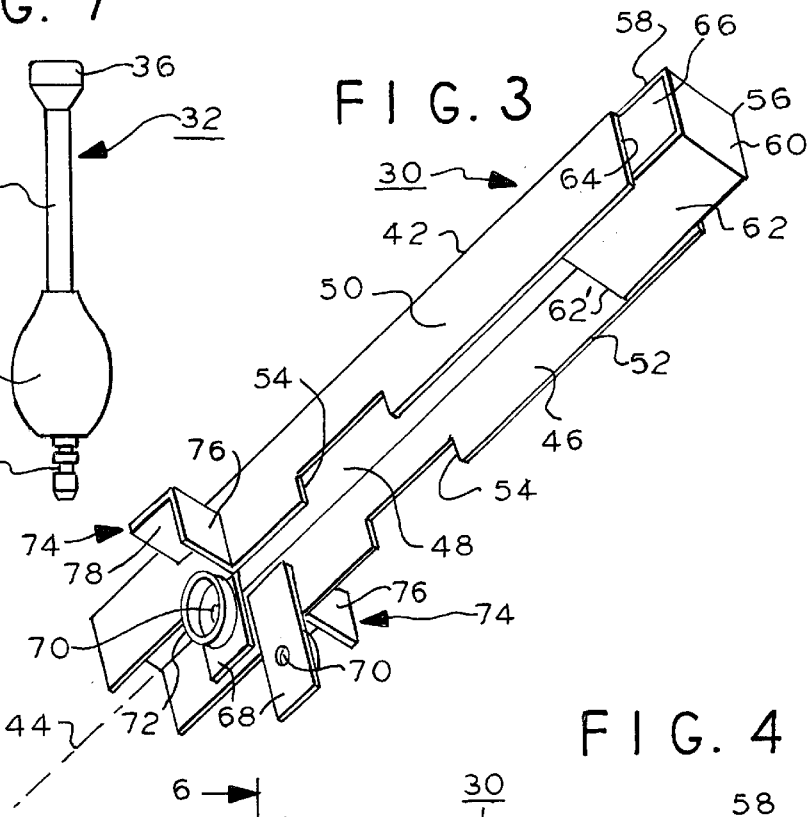
FIG. 4
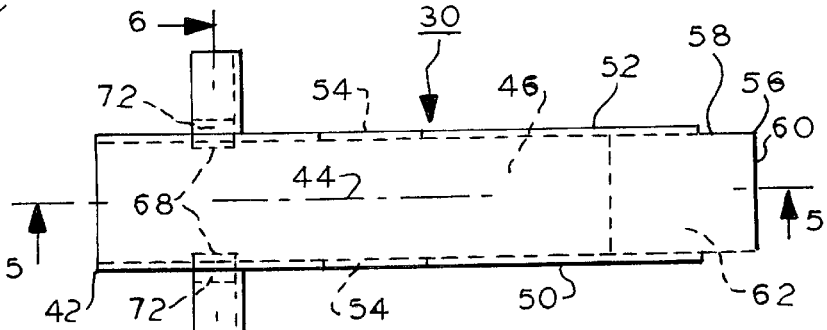
FIG. 5
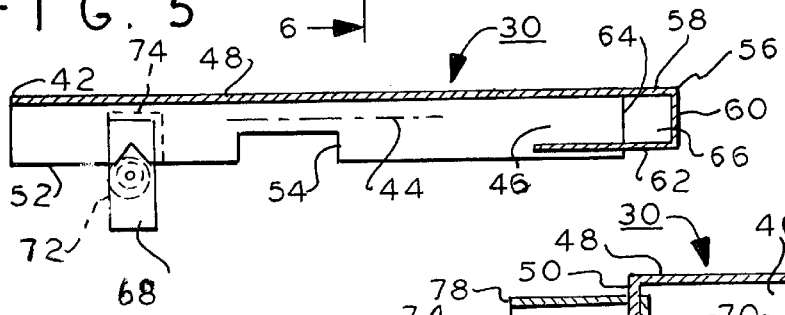
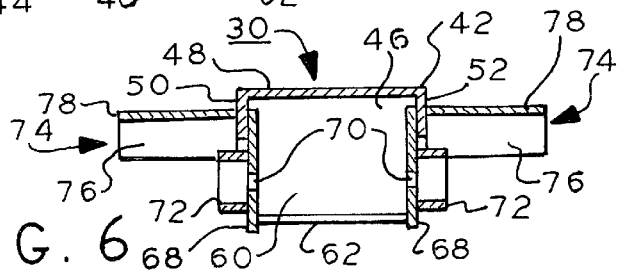
FIG. 6

PLUG DOOR HANDLE BOLT SEAL LOCKING DEVICE

This invention relates to bolt seal locking devices used on rail car plug doors, and more particularly, to a seal and plug door handle protector for locking the door handle closed.

CROSS REFERENCE TO RELATED APPLICATIONS AND PATENTS

Of interest are commonly owned U.S. Pat. Nos. 5,413,393 and 5,347,689, both in the name of Georgopoulos et al., U.S. Pat. No. 5,878,604 in the name of Stone et al., U.S. Pat. Nos. 6,036,240 and 6,010,166 both in the name of Hamilton et al., U.S. Pat. No. 6,009,731 in the name of Emmons et al. and U.S. Pat. No. 5,732,989 in the name of Stevenson et al., all of which relate to bolt seals and which are fully incorporated by reference herein. U.S. Pat. No. 5,372,989 discloses a releasable bolt seal in which both the shank and locking body are reusable, the locking body being releaseably attached to the bolt seal shank.

Cargo shipping vehicles and containers, and in particular, rail cars, are subject to widespread tampering due to the value of the cargo. One type of rail car employs what are known as plug doors. Such doors are attached to the side of a rail car and displace in two orthogonal directions. The door moves in translation toward and away from the rail car side wall to close and open an opening in a side of the rail car. The door is attached to wheels mounted on a wheel truck by keeper bars. The truck wheels ride on rails extending along the side of the rail car side wall. The keeper bars rotate and include a crank portion. The crank portion displaces the door in and out of the opening as the bars are rotated.

When the door is outside the opening, it can then be displaced parallel to the side wall via the wheels and rails to expose the opening. A crank mechanism is provided on the door side to rotate the keeper bars to open and close the doors. An elongated handle is connected to the crank mechanism for operating the mechanism, which is typically a gearing arrangement. The mechanism is enclosed by a cover or covers. Different mechanisms have somewhat different covers and handles.

A yoke assembly is attached to the door adjacent to one end of the handle. The yoke assembly includes a pivoted yoke that captures the handle one end. A padlock may be secured to the yoke to lock the handle and prevent it from being rotated to the open position. Such padlocks have exposed shackles and may be opened by tampering using bolt cutters and the like.

Padlock protectors are known. Also, bolt seals employing shanks with heads on one end and a locking body on the other shank end may be used to lock some latches. Examples of such bolt seals are disclosed in the aforementioned commonly owned patents for example.

U.S. Pat. No. 5,413,393 illustrates a one time use bolt seal and a tool for breaking the shank at the head end of the shank. The tool engages the head and manually bends the shank which breaks due to serrations in the shank.

In U.S. Pat. No. 5,118,149, a container hasp protector is disclosed. A metal box-like body has a top plate, a bottom plate, right and left side plates, an open rear face and a front face. A shield plate is on the front face and extends between the side plates forming a top opening in the face between the shield plate and top plate and a bottom opening in the face between the shield plate and the bottom plate. The body is arranged to protect the hasp from intentional breakage.

The shield plate has an aperture which cooperates with aligned apertures in a hasp to receive a breakaway security seal. The problem with this device as recognized by the present inventors is that this device is not useful with plug door handles and latches.

U.S. Pat. No. 3,951,443 discloses a security lock that employs a locking pin. The lock employs interengaged keepers with aligned through apertures which receive the pin. One of the keepers has a through pilot hole in the face thereof so that the pin can be cut apart with a heavy duty power drill for use by an authorized person. The only way for the lock to be opened is by destroying the pin. This device is not satisfactory for use with plug door handles.

Padlock protector devices are disclosed in U.S. Pat. Nos. 4,898,008, 4,033,155, 5,146,771, and 5,477,710. These also are not satisfactory for cargo shipping containers or rail cars because the shackles are readily exposed for destruction by a tamperer. Further these devices are not disclosed as operative with bolt seals of the type described above.

The present inventors recognize a need for a cost effective seal and latch protection device for use with plug door handles and latches. They recognize a need for a protection device which precludes access to the bolt shank which is vulnerable to tampering. For this purpose, they recognize that the reusable bolt seal of U.S. Pat. No. 5,732,989 is advantageous in that the bolt shank can be substantially protected from tampering while permitting the bolt seal to be released.

A handle lock and seal protector according to the present invention is for a rail car plug door handle and latch, the handle for rotation about a pivot to open and close the latch, the door including at least one appurtenance extending therefrom, the protector for use with a bolt seal having a head, a shank and a lock body for locking the protector to the handle. The protector comprises a casing defining a chamber and a longitudinal axis, the chamber for receiving the handle and enclosing the pivot, the casing having a plurality of bolt seal apertures for receiving the bolt seal shank to lock the casing to the received handle with the bolt seal. Displacement inhibiting means are secured to the casing for engaging the at least one appurtenance to preclude the rotation of the received handle relative to the door and for precluding axial removal of the secured casing from the handle.

In one aspect, the casing includes a pair of spaced members extending therefrom, the members having the apertures.

In a further aspect, the members comprise a pair of spaced legs each depending from a casing side wall.

In a further aspect, each leg includes a tubular member aligned with the apertures for receiving and protecting the bolt seal, the tubular member extending transversely the axis outwardly from the corresponding side wall, the tubular member and apertures being positioned so that the received handle is between the received bolt seal and cover wall.

In a still further aspect, the inhibiting means includes an end wall for precluding axially displacement of the casing relative to the received handle along the axis in a first direction and further means for precluding axial displacement of the casing in a second direction opposite the first direction.

The further means may comprise a projection extending from the casing for engaging the at least one appurtenance, the projection for precluding the rotation and axial displacement of the casing relative to the handle in the second direction.

In a further aspect, the displacement inhibiting means comprises a member extending outwardly each the side wall for engaging the at least one appurtenance, the end wall and member for cooperatively precluding axially displacement of the casing in opposing directions along the axis.

An end wall at one casing end and a bottom wall at the one end may cooperatively enclose the one end, the inhibiting means may include the enclosed one end and a member extending transverse the axis from one of the side walls distal the end wall for engaging the at least one appurtenance.

IN THE DRAWING

FIG. 3 is an isometric view of the protector of FIG. 2;

FIG. 4 is a top plan view of the protector of FIG. 3;

FIG. 5 is a sectional side elevation view of the protector of FIG. 4 taken along lines 5—5;

FIG. 6 is a sectional end elevation view of the protector of FIG. 4 taken along lines 6—6;

FIG. 7 is a side elevation view of a bolt seal used in the embodiment of the present invention.

Figure 1:
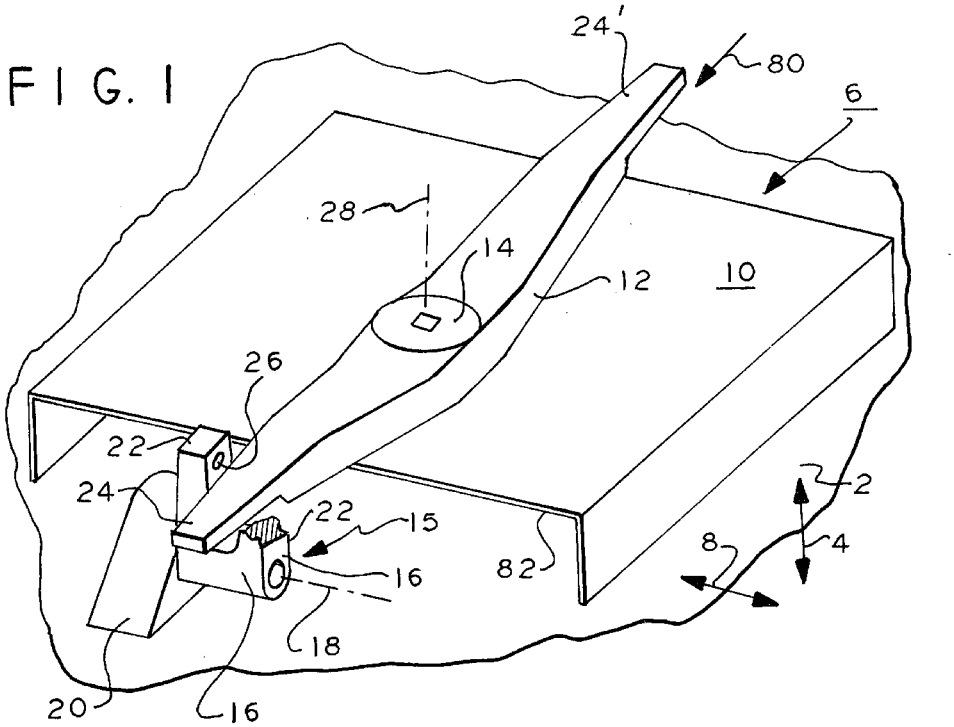
FIG. 1 is an isometric view of a plug door handle, latch and latch mechanism cover assembly.

In FIG. 1, plug door 2 is normally vertical for enclosing an opening in the side of a rail car. The door 2 is cranked open and closed in directions 4 by crank assembly 6. Once the door is cranked open, it is displaced along the side of the rail car on wheels (not shown) in directions 8 normal to directions 4.

Crank assembly 6 comprises a crank mechanism, which may be gears and the like (not shown), enclosed by cover 10 secured to outer side of the door 2. An elongated handle 12 is connected to and for operating the crank mechanism by a shaft 14. The mechanism operates links (not shown) extending transversely from the cover 10 in directions 8. The links are connected to keeper bars (not shown) having crank arms at their ends.

The crank arms are pivoted in wheel trucks (not shown) mounted on rails that run along the rail car side. When the crank arms are rotated, the door 2 is translated in a selected one of directions 4. When the door is opened, it can then be rolled in one of directions 8 on the rails to expose the opening. The door 2 is referred to as a plug door.

Secured to the side of door 2 is a latch 15. Latch 15 comprises a yoke 16 pivoted about axis 18 to stanchion 20. Yoke 16 has a pair of arms 22 forming a space therebetween for receiving end 24 of handle 12. Arms 22 each have a hole 26 (one being shown) for receiving a padlock shackle (not shown) or bolt seal shank. The padlock or bolt seal lock the yoke 16 to the position shown preventing the handle from rotating about its axis 28.

When it is desired to open the door 2, the yoke 22 is pivoted to free the handle 12 for rotation about axis 28. The problem with this arrangement is that the lock shackle or bolt seal shank are exposed to tampering tools such as bolt cutters and cutting torches and so on.

While one type of handle 12 and mating link operating mechanism cover 10 is shown, these may vary from rail car to rail car somewhat. In some arrangements, the mechanism may be formed in several layers including a circular cylindrical cover (not shown) overlying the cover 10 adjacent to the handle for enclosing certain gear arrangements and the like. Generally, there is always a rectangular cover similar to cover 10 and an elongated handle similar to the handle 12 in the various rail car plug doors.

Figure 2:
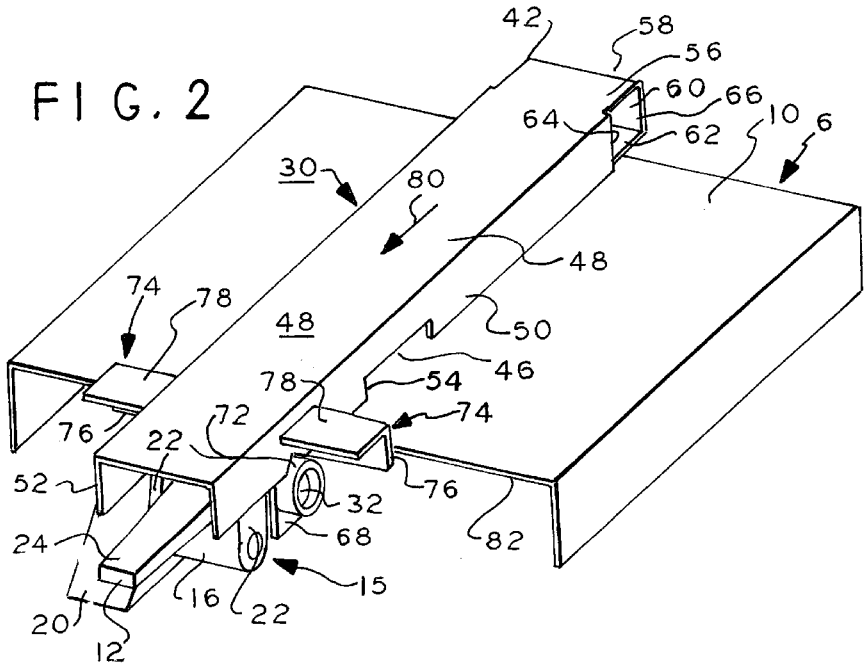
FIG. 2 is an isometric view of the assembly of FIG. 1 locked with a bolt seal and protector according to an embodiment of the present invention.

In FIG. 2, handle lock and seal protector 30 encloses the handle 12 and pivot shaft 14. Protector 30 receives a bolt seal 32, FIG. 7, for locking the handle in the locked position shown. The bolt seal 32, FIG. 7, includes a shank 34, a head 36 secured to one shank end and a locking body 38 containing a lock mechanism (not shown) for locking the body selectively to the shank 34 via grooves 40 in the shank.

In other bolt seals as described in the aforementioned commonly owned patents such grooves are not essential. Preferably seal 32 is releasable and reusable as shown and described in the aforementioned U.S. Pat. No. 5,732,989 incorporated by reference herein. The protector 30 in cooperation with the yoke 16 and cover 10 substantially encloses the bolt seal shank 34 (not shown in FIG. 2) and prevents rotation of the handle about axis 28.

Protector 30, FIGS. 2–6, comprises an elongated casing 42 defining a longitudinal axis 44 and a chamber 46. The casing 42 comprises a preferably planar cover wall 48 and two parallel spaced planar side walls 50, 52 depending from the cover wall 48. The side walls 50, 52 have transversely aligned rectangular notches 54. The notches 54 accommodate those mechanism covers which include a further cylindrical or other shaped mechanism covers (not shown) over the cover 10. The casing is preferably sheet steel.

The cover wall 48 terminates in a U-shaped sheet metal member 56 at end 58 of the casing 42. Member 56 comprises an end wall 60 normal to the cover wall 48 and a bottom wall 62 parallel to the cover wall 48 and juxtaposed therewith. The bottom wall 62 terminates at one end at edge 62' interior the chamber 46 and at its other end at end wall 60. The side walls 50 and 52 terminate at edge 64 spaced from the end wall 60 forming space 66 between edge 64 and end wall 60. A portion of the bottom wall 62 overlies a portion of the cover wall 48. The various walls are preferably welded to each other at their respective abutting edges.

Two planar sheet metal legs 68 are secured to and depend from the interior surface of respective side walls 50 and 52. In FIG. 3, each leg 68 has a shank 34 (FIG. 7) receiving hole 70. Holes 70 are axially aligned on an axis transverse to axis 44. The holes 70 are spaced from cover wall 48 a distance such that the handle 12 (FIG. 2) is received in the chamber 46 between the cover wall 48 and the axis of holes 70. A ring-like relatively short tubular member 72 is secured external each leg 68 and circumferentially about and concentric with each hole 70.

An angle member 74 having two legs 76 and 78 at right angles to each other extends laterally from each side wall 50 and 52 normal to axis 44. Member 74 may be a conventional angle iron. Legs 76 extend in a direction that is parallel to legs 68 and legs 78 are parallel to the cover wall 48.

In operation, the protector 30 is slipped over the end 24', FIG. 1, of the handle 12 in the axial direction 80. Handle end 24' is located between the cover wall 48 and the bottom wall 62, FIG. 3, at casing 30 end 58. The handle 12 is then located in the chamber 46. Notches 54 are not essential in this combination of cover 6 and handle 12.

Legs 68 preclude rotation of the handle 12 and protector 30 about axis 28 (FIG. 1). The cover 6 has an edge 82, FIGS. 2 and 8. This edge serves as an appurtenance against which the legs 76 of members 74 abut or are closely spaced. The legs 76 are adjacent to covers similar to cover 10 to preclude rotation of the protector 30 for the various different handle and latch mechanisms present on different rail cars, which may comprise about 20 different configurations.

Figure 8:
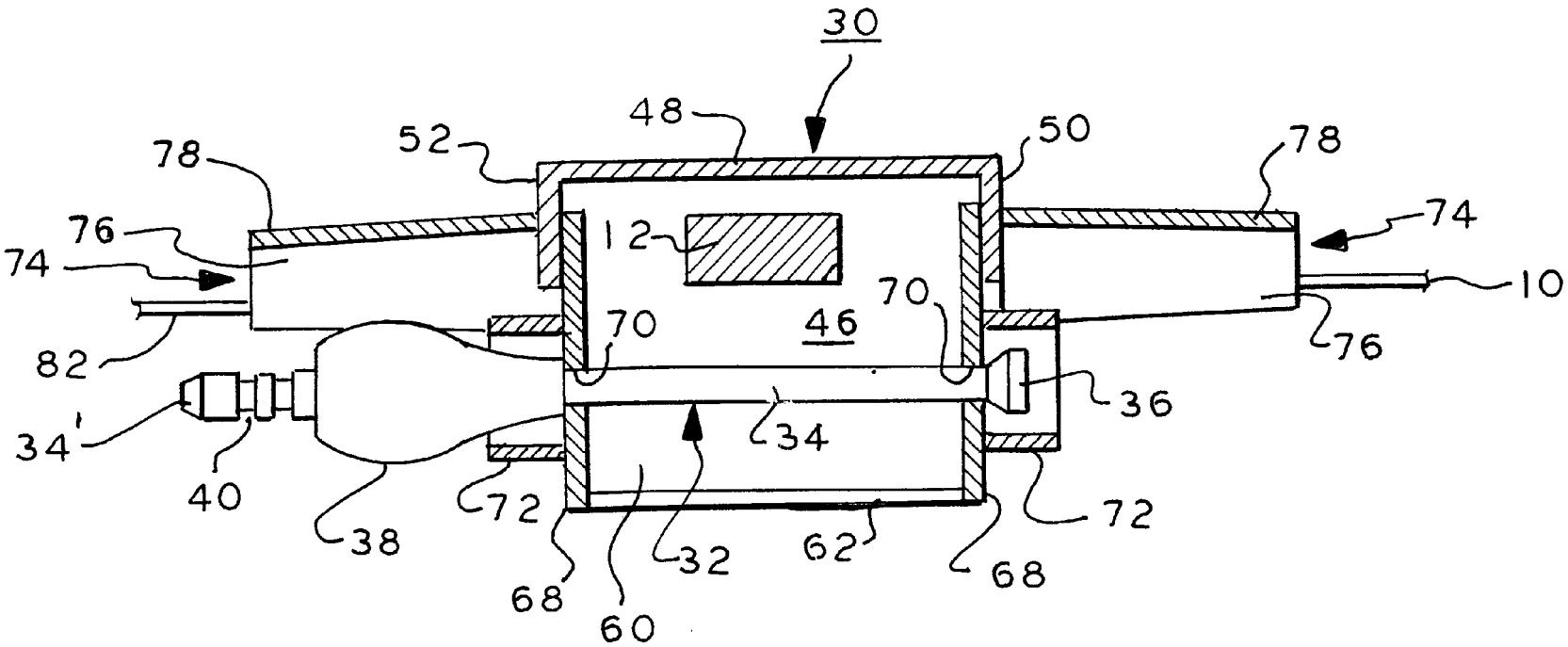
FIG. 8 is a sectional end elevation view of the Protector of FIG. 2 similar to the view of FIG. 6 showing the handle locked by a bolt seal.

With the protector 30 installed as shown in FIGS. 2 and 8, the bolt seal shank receiving holes 70, FIGS. 3 and 6, are located in a plane beneath the received handle 12 end 24, FIG. 8. The seal 32 shank 34 is then passed through the holes 70. The bolt seal head 36 is seated in the recess formed by one tubular member 72 and surrounded by that tubular member 72, FIG. 8. This structure precludes access to the shank 34 at the head end by tampering tools.

The locking body 36, FIG. 8, is attached to the shank 34 free end 34'. The locking body 38 portion adjacent to the shank is surrounded by the corresponding tubular member 72 so that the shank 34 is also annularly protected from tampering tools at this location. Tampering with the protruding end of the shank 34 and locking body does not assist in easy opening of the lock with tampering tools and does not provide easy access to the shank for such tampering tools.

The locking body 38, in this embodiment, is releaseably opened by a special tool adapted for this purpose. This tool is described further in the aforementioned U.S. Pat. No. 5,732,989. However, it should be understood that other types of locking seals that are not reusable may also be employed as desired. These seals require access to the shank or head for opening the seal as disclosed in certain of the aforementioned commonly owned patents noted in the introductory portion.

In the position shown in FIG. 2, the latch 15 yoke 16 including arms 22 form an appurtenance that blocks the end of the protector chamber 46. The latch 15 and handle 12 cooperate to prevent access to the shank 34 in the chamber 46 with tampering tools. The handle end 24 blocks access to the chamber 46 by tampering tools through the end of the protector 30. The angle members 74 provide further shielding of the shank, head 36 and locking body 38 along or from the sides of the seal shank from easy access by tampering tools in the region between the cover 10 and seal 32. The lock body 38 may abut the adjacent member 74 and shields the lock body further. In addition, the plug door appurtenance formed by the latch 15 and handle mechanism cover 10 at edge 82 also assists in blocking access to the bolt seal shank 34 in that region.

The protector end wall 60 cooperates with the appurtenances formed by yoke 16 and cover 10 in combination with the legs 68 and latch at edge 82 to preclude axial displacement of the protector 30 along axis 44 in opposing directions and in a direction opposite direction 80. The locked seal shank 34 is located under the handle 12 end 24, FIG. 8, preventing the protector 30 from being removed from the handle by lifting the protector 30. The locked handle 12 can not be rotated, locking the door 2 closed.

There thus has been described a bolt seal and handle protector for securing the plug door handle and corresponding bolt seal shank from tampering tools. The protector includes shield members cooperating with appurtenances on the plug door for precluding access to the bolt seal shank, substantially enclosing the shank to preclude access by tampering tools. The protector is universal and accommodates a variety of differently designed plug door latches, handles and operating mechanisms.

It will occur to one of ordinary skill that various modifications may be made to the disclosed embodiments. Such embodiments are given by way of illustration and not limitation. It is intended that the scope of the invention be defined by the appended claims.

For example, the chamber 46 is defined by rectilinear walls. However, the chamber may have other shapes. Weld joints are optional. The protector may be made from one piece sheet metal, preferably steel. The shield members are shown as angle members and tubular, but may be other shapes. For example, the tubular members may be angularly joined members. The members 74 may have any desired shape and configuration. For example, they may be solid or hollow rods or tubes, circular or rectangular in transverse section. Notches 54 are optional.

What is claimed is:

1. A handle lock and seal protector for a rail car plug door handle and latch, the handle for rotation about a pivot to open and close the latch, the door including at least one appurtenance extending therefrom, said protector for use with a bolt seal having a head, a shank and a lock body for locking the protector to the handle, the protector comprising:

a casing defining a chamber and a longitudinal axis, said chamber receiving the handle and enclosing said pivot, said casing having a plurality of bolt seal apertures for receiving said bolt seal shank to lock the casing to the received handle with said bolt seal; and displacement inhibiting device secured to the casing engaging the at least one appurtenance to preclude the rotation of said received handle relative to the door and for precluding axial removal of the secured casing from the handle along the longitudinal axis.

2. The protector of claim 1 wherein the casing includes a pair of spaced members extending therefrom, said members having said apertures.

3. The protector of claim 2 wherein the casing has a handle cover wall and opposite side walls depending from the cover wall, the members comprising a pair of spaced legs each secured to a side wall, each leg having one of said apertures.

4. The protector of claim 3 wherein each leg includes a tubular member aligned with the corresponding aperture for receiving and protecting said bolt seal, the tubular member extending transversely said axis outwardly from the corresponding side wall, said tubular members and apertures being positioned so that the received handle is between the received bolt seal and cover wall.

5. The protector of claim 1 wherein the casing includes a cover wall and an end wall depending from the cover wall and intersecting the axis, said inhibiting device including said end wall for precluding axially displacement of the casing relative to the received handle along said axis in a first direction and an arrangement for precluding axial displacement of the casing in a second direction opposite the first direction.

6. The protector of claim 5 wherein the arrangement comprises a projection extending from the casing for engaging said at least one appurtenance, said projection for precluding said rotation and axial displacement of the casing relative to the handle in said second direction.

7. The protector of claim 1 wherein the casing has opposing side walls and an end wall each depending from a cover wall, the end wall intersecting the axis, said displacement inhibiting device comprising a member extending outwardly each said side wall for engaging said at least one appurtenance, the end wall and member for cooperatively precluding axially displacement of the casing in opposing directions along said axis.

8. The protector of claim 1 wherein the casing has a pair of side walls, a handle cover wall, an end wall at one casing end and a bottom wall at the one end for cooperatively enclosing the one end, said inhibiting device including said enclosed one end and a member extending transverse said axis from one of said side walls distal the end wall for engaging the at least one appurtenance.

9. The seal of claim 1 wherein the displacement inhibiting device comprises first wall secured to the casing at one casing end for enclosing the one casing end and precluding axial di placement of the casing along the axis in one direction relative to the handle and a device for inhibiting axial displacement of the casing along the axis in a second direction opposite the one direction.

10. The seal protector of claim 1 wherein the casing includes means cooperating with the at least one appurtenance and handle for enclosing said bolt seal shank to preclude access to the shank by tampering tools.

11. A seal protector for use with a bolt seal having a head, a shank and a locking body, the protector for a rail car plug door handle and latch, the rail car door including a latch mechanism cover secured to the door and an elongated handle coupled to the mechanism through the cover for operating the plug door latch by rotation of the handle, the protector comprising:

a casing having a chamber receiving the handle and enclosing a pivot and defining a longitudinal axis;

a rotation inhibiting device secured to the casing cooperating with the cover precluding rotation of said received handle;

axial inhibiting device secured to the casing for precluding an axial removal of the casing from the handle in a direction along said axis; and a bolt seal receiving device secured to the casing for receiving said bolt seal to lock the casing to the handle.

12. The protector of claim 11 wherein the bolt seal receiving device comprises a pair of spaced legs depending from the casing, each leg having a bolt shank receiving aperture and being arranged so that the casing and the received bolt seal lock the casing to the handle in a direction normal to said axis.

13. The seal protector of claim 11 wherein the axial inhibiting device comprises an end wall on the casing and an L-shaped member extending transversely the axis from the casing distal the end wall.

14. The seal protector of claim 13 wherein said L-shaped member includes device for forming said rotation inhibiting means.

15. A seal protector for use with a bolt seal including a head, a shank and a locking body for securing a rail car plug door having a rotatable latch handle and at least one appurtenance, the protector comprising:

a housing defining an axis and a chamber receiving the latch handle and enclosing a pivot along the axis, said housing having a base wall, two spaced side walls, an end wall at one housing end and a bottom wall at the one housing end for receiving one end of the handle;

first and second legs depending from the housing at a region distal the one end;

first and second tubular members, the first member secured to the first leg and the second member being secured to the second leg, said legs and members having first and second spaced bolt seal receiving openings aligned transverse said axis, said handle for being received between said received bolt seal and said base wall; and at least one member extending transversely from said side walls engaging said at least one appurtenance and precluding rotation of the housing and received handle relative to the door, said at least one member cooperating with said end wall for precluding axial removal of the casing from the received handle.

16. The seal protector of claim 15 wherein the housing walls, legs, at least one member and tubular members include device for cooperating with the at least one appurtenance and the handle for enclosing said bolt seal shank to preclude access to the shank by tampering tools.

* * * * *

UNITED STATES PATENT AND TRADEMARK OFFICE

CERTIFICATE OF CORRECTION

PATENT NO. : 6,698,806 B2 
DATED : March 2, 2004
INVENTOR(S) : Terrence N. Brammall, Craig B. Hamilton and Stanley Gilbert It is certified that error appears in the above-identified patent and that said Letters Patent is hereby corrected as shown below:

Title page,
Item [56], References Cited, U.S. PATENT DOCUMENTS, should read:

| | | |
|---|---|---|
| -- 3,951,443 | 4/1976 | Barnaby |
| 4,033,155 | 7/1977 | DeLucia |
| 4,898,008 | 2/1990 | Eberly |
| 5,118,149 | 6/1992 | Emmons |
| 5,146,771 | 9/1992 | Loughlin |
| 5,477,710 | 12/1995 | Stefanutti |
| 5,413,393 | 5/1995 | Georgopoulos et al. |
| 5,347,689 | 9/1994 | Georgopoulos et al. -- |

Signed and Sealed this

Eighth Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,698,806 B2 
DATED : March 2, 2004
INVENTOR(S) : Terrence N. Brammall, Craig B. Hamilton and Stanley Gilbert It is certified that error appears in the above-identified patent and that said Letters Patent is hereby corrected as shown below:

Column 7,
Line 7, change “di placement” to -- displacement --
Line 28, add -- an -- before “axial”; delete “for”
Line 29, delete “an”

Signed and Sealed this

Twenty-fifth Day of January, 2005

JON W. DUDAS
*Director of the United States Patent and Trademark Office*